United States Patent [19]

Töpfl et al.

[11] Patent Number: 4,721,512

[45] Date of Patent: Jan. 26, 1988

[54] PROCESS FOR AFTERTREATING DYED CELLULOSIC MATERIAL

[75] Inventors: Rosemarie Töpfl, Dornach; Heinz Abel; Jörg Binz, both of Reinach, all of Switzerland

[73] Assignee: Ciba-Geigy Corporation, Ardsley, N.Y.

[21] Appl. No.: 925,058

[22] Filed: Oct. 30, 1986

[30] Foreign Application Priority Data

Nov. 25, 1985 [CH] Switzerland ..... 5021/85

[51] Int. Cl.[4] ..... D06M 1/00

[52] U.S. Cl. ..... 8/188; 8/181

[58] Field of Search ..... 8/188, 189, 127.51, 8/127.6, 128, 606, 608, 918

[56] References Cited

U.S. PATENT DOCUMENTS

| | | | |
|---|---|---|---|
| 2,891,835 | 6/1959 | Matter | 8/606 |
| 3,097,039 | 7/1963 | Buehler | 8/606 |
| 3,253,881 | 5/1966 | Donahue | 8/188 |
| 3,403,113 | 9/1968 | Diethelm | 528/342 |

*Primary Examiner*—Paul Lieberman
*Assistant Examiner*—John F. McNally
*Attorney, Agent, or Firm*—Edward McC. Roberts; Meredith C. Findlay

[57] ABSTRACT

A process for aftertreating cellulosic fibre material using an aqueous liquor which comprises (A) a diquaternary ammonium salt of formula (1)

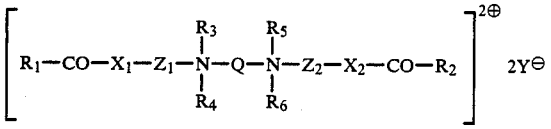

wherein

Q is a divalent aliphatic hydrocarbon radical of 2 to 12 carbon atoms which may be interrupted in the chain by oxygen atoms and is unsubstituted or substituted by hydroxy groups, $R_1$ and $R_2$ are each independently of the other an aliphatic radical of 6 to 24 carbon atoms, $R_3$ to $R_6$ are each independently of the other lower alkyl, hydroxy-lower alkyl or lower alkoxy-lower alkyl, $X_1$ and $X_2$ are each oxygen or —NH—, $Z_1$ and $Z_2$ are each independently of the other $C_2$-$C_6$alkylene, and $Y^{\ominus}$ is an anion of a strong inorganic or organic acid, and (B) a polybasic nitrogen-containing polycondensate.

18 Claims, No Drawings

PROCESS FOR AFTERTREATING DYED CELLULOSIC MATERIAL

The present invention relates to a process for aftertreating dyed cellulosic material, in particular cellulosic textile material.

When aftertreating dyeings on cellulosic textile material with conventional products for enhancing fastness properties, a hardening of the fabric usually occurs which has a deleterious effect on the textile mechanical properties. In particular, the handle and sewability of the textile material are impaired. A novel aftertreatment process has now been found that not only enhances the fastness properties, but also avoids the shortcomings referred to above.

Accordingly, the present invention relates to a process for aftertreating dyed cellulosic fibre material, which comprises treating said material with an aqueous liquor which contains (A) a diquaternary ammonium salt of formula (1)

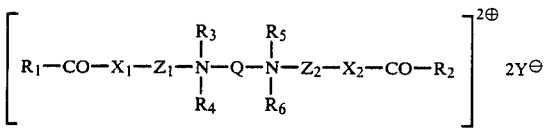

wherein

Q is a divalent aliphatic hydrocarbon radical of 2 to 12 carbon atoms which may be interrupted in the chain by oxygen atoms and is unsubstituted or substituted by hydroxyl groups, $R_1$ and $R_2$ are each independently of the other an aliphatic radical of 6 to 24 carbon atoms, $R_3$ to $R_6$ are each independently of the other lower alkyl, hydroxylower alkyl or lower alkoxy-lower alkyl, $X_1$ and $X_2$ are each oxygen or —NH—, $Z_1$ and $Z_2$ are each independently of the other $C_2$–$C_6$alkylene, and $Y^{\ominus}$ is an anion of a strong inorganic or organic acid, and (B) a polybasic nitrogen-containing polycondensate.

Components (A) and (B) may be present as single compounds or as a mixture with each other.

In the definition of the radicals of formula (1) and in the subsequent formulae, lower alkyl and lower alkoxy denote those groups or moieties which contain 1 to 5, preferably 1 to 3, carbon atoms. Lower alkyl groups are for example methyl, ethyl, n-propyl, isopropyl, n-butyl, sec-butyl, tert-butyl or amyl, and lower alkoxy groups are for example methoxy, ethoxy or isopropoxy.

The aliphatic radicals $R_1$ and $R_2$ may be straight chain or branched. Together with the —CO— group, they preferably form the acid radical of an unsaturated or, preferably, saturated aliphatic carboxylic acid of 8 to 24 carbon atoms. Examples of suitable aliphatic carboxylic acids are: 2-ethylhexanoic acid, capric acid, lauric acid, coconut fatty acid, myristic acid, palm oil fatty acid, palmitic acid, tallow fatty acid, oleic acid, ricinoleic acid, linoleic acid, linolenic acid, stearic acid, arachidic acid, arachidonic acid, behenic acid, erucic acid or lignoceric acid. Behenic acid is the preferred acid. It is also possible to use the mixtures of these acids obtained by the cleavage of natural oils or fats.

Coconut fatty acid, palm oil fatty acid, palmitic acid/stearic acid mixtures, tallow fatty acid and, in particular, arachidic acid/behenic acid mixtures are especially preferred mixtures.

Preferably each of $R_1$ and $R_2$ is a $C_7$–$C_{23}$alkyl radical, most preferably a $C_{19}$–$C_{21}$alkyl radical.

The lower alkyl radicals $R_3$ to $R_6$ are preferably identical and are preferably methyl, ethyl, isopropyl or hydroxyethyl, with methyl being especially preferred.

$X_1$ and $X_2$ are preferably —NH—.

$Z_1$ and $Z_2$ are preferably a $C_2$–$C_5$alkylene group which may be straight chain or branched and is e.g. the

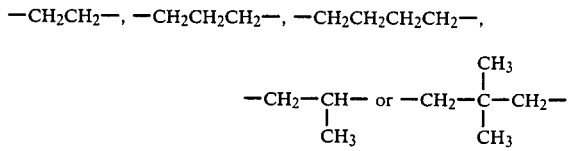

group. —$CH_2CH_2$— and, in particular, —$CH_2CH_2CH_2$— are most preferred.

The aliphatic hydrocarbon chain in the bridge Q contains preferably 3 to 10 carbon atoms. It may be straight chain or branched.

Preferably Q is a $C_3$–$C_{10}$alkylene radical which may be interrupted in the chain by oxygen and is unsubstituted or substituted by hydroxyl groups. The alkylene radical is preferably substituted by hydroxy.

Preferred bridges Q are

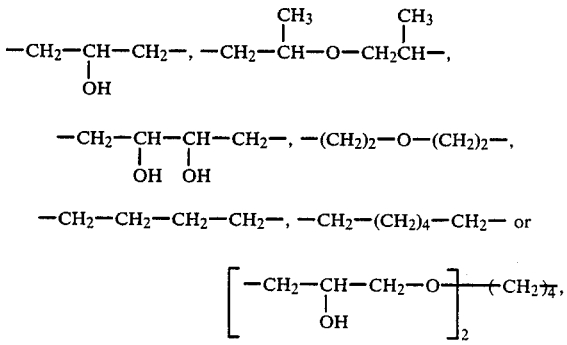

with

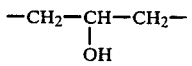

or, in particular,

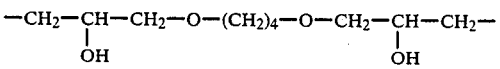

being most preferred.

Suitable anions $Y^{\ominus}$ are anions of inorganic acids, e.g. the chloride, bromide, fluoride, iodide or sulfate ion, as well as anions of organic acids, e.g. of aromatic or aliphatic sulfonic acids, e.g. the benzenesulfonate, p-toluenesulfonate, chlorobenzenesulfonate, methanesulfonate or ethanesulfonate ion, and also the anions of lower carboxylic acids such as the acetate, propionate or oxalate ion.

$Y^{\ominus}$ is preferably the chloride, bromide, sulfate or p-toluenesulfonate ion.

The diquaternary ammonium salts of formula (1) are prepared in a manner known per se. They are preferably prepared by reacting 1 mole of a compound of formula

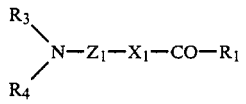

(2a)

and 1 mole of a compound of formula

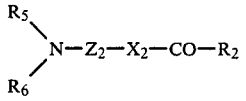

(2b)

or 2 moles of the same compound with 1 mole of a compound which introduces Q and contains two functional groups, e.g. epihalohydrin, a dihaloalkane, a dihaloalkyl ether, an olefin dioxide, a diepoxy compound such as an $\alpha,\omega$-alkanediol diglycidyl ether or an alkanediol alkylsulfonate or alkanediol arylsulfonate.

The reaction is preferably carried out in a polar solvent and, if necessary, with the addition of a hydrohalic acid such as hydrochloric acid or sulfuric acid.

Suitable polar solvents are water or, preferably, water-miscible organic solvents. Examples of water-miscible organic solvents are aliphatic $C_1$–$C_3$alcohols such as methanol, ethanol or the propanols; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone and diacetone alcohol; ethers such as diisopropyl ether, diphenyl oxide, dioxane, tetrahydrofuran, as well as tetrahydrofurfuryl alcohol, acetonitrile, $\gamma$-butyrolactone or N,N-dimethylformamide. Mixtures of these solvents may also be used.

Suitable basic non-quaternised, nitrogen-containing polycondensates as component (B) are amino group-containing condensates which are obtained by reacting dicyandiamide, cyanamide, guanidine or bisguanidine and polyalkylenepolyamines containing not less than three primary and/or secondary amino groups, which condensates may be further reacted with epihalohydrin. These polycondensates (C) and the corresponding starting materials are known from DE-B No. 1 595 390 and can be prepared in accordance with the method described therein.

Preferred condensates are reaction products of polyalkylenepolyamines containing not less than 3 amino groups and dicyandiamide or cyandiamide. Reaction products of diethylenetriamine and dicyandiamide are especially preferred. As polyamines, however, it is also possible to use triethylenetetramine, pentaethylenehexamine, dipropylenetriamine, N-bis(aminopropyl)methylamine and their mixtures or the mixtures of polyamines obtained in the synthesis of such polyamines.

Further basic nitrogen-containing polycondensates suitable for use as component (B) are (2) reaction products of a peralkylated aliphatic di- or triamine with a dihaloalkyl ether, e.g. $\beta,\beta'$-dibromodiethyl ether or $\beta,\beta'$-dichlorodiethyl ether. Such polyquaternary ammonium salts are disclosed e.g. in DE-C-No. 894 237.

Particularly preferred polyquaternary ammonium salts contain the recurring unit of formula

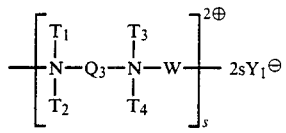

(3)

wherein $Q_3$ is a $C_2$–$C_6$alkylene radical which may be interrupted by $—NT_5—$, $T_1$ to $T_5$ are each independently lower alkyl or hydroxy-lower alkyl, W is the group $—CH_2CH_2—O—CH_2CH_2—$, $—CH_2—CH(CH_3)—O—CH(CH_3)—CH_2—$ or $—(CH_2)_2—O—(CH_2)_2—O—(CH_2)_2—$, s is 2 to 50, preferably 3 to 30, and $Y_1^{\ominus}$ is an anion of a strong inorganic or organic acid.

The $—NT_5—$ group may also be quaternised.

An especially preferred polyquaternary ammonium salt suitable for use as component (2) contains the recurring unit of formula

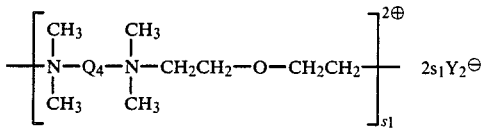

(4)

wherein $Q_4$ is $—(CH_2)_6—$ or, preferably, $—CH_2CH_2—N(CH_3)—CH_2CH_2—$, $s_1$ is 3 to 20, and $Y_2^{\ominus}$ is the bromide, sulfate or, preferably, chloride ion.

Components (A) and (B) are usually employed in a weight ratio of 4:1 to 1:4, preferably 3:1 to 1:2.

Components (A) and (B) are normally added separately, simultaneously or stepwise to the aftertreatment liquor. They can, however, also be employed in the form of an aqueous formulation. This formulation can be prepared by simple stirring of the components in water, if necessary by heating to 50°–70° C., and diluting with water to give a 20 to 40% solution.

The aftertreatment of the dyed cellulosic fibre material according to this invention is normally carried out after dyeing, but preferably from a fresh bath.

Suitable cellulose fibre material is that made of regenerated or, preferably, natural cellulose such as viscose rayon, viscose silk, hemp, jute or, preferably, cotton, as well as blends with synthetic fibres, e.g. polyamide/cotton blends or, in particular, polyester/cotton blends, the polyester component of which can be dyed with disperse dyes.

The textile material can be in any form, e.g. as yarns, hanks, wovens, knits, felted fabrics, but is preferably in the form of textile planar fabrics such as woven fabrics, knitwear or carpeting, which may consist wholly or partly of native, regenerated or modified cellulose.

The cellulosic fibre material is usually dyed with reactive dyes or with substantive dyes. Dyeing can be carried out by the exhaust process or by two-step processes such as the pad dyeing process or by printing. The preferred pad dyeing process is the pad-steam process or cold pad batch process.

The amount of dye employed depends on the desired depth of shade. In general, amounts of 0.1 to 10 percent by weight, preferably 0.5 to 5 percent by weight, based on the material, have proved useful.

Suitable substantive dyes are the conventional direct dyes, for example those listed under the heading "Direct Dyes" in the Colour Index, 3rd edition (1971), Vol. 2, on pages 2005–2478.

By reactive dyes are meant the conventional dyes which form a chemical bond with cellulose, e.g. those listed under the heading "Reactive Dyes" in the Colour Index, Vol. 3, 3rd. edition (1971), on pages 3391–3560, and in Vol. 6, revised 3rd edition (1975), on pages 6268–6345.

The advantages of the process of this invention are especially evident when aftertreating dyeings produced with substantive dyes. Particularly suitable substantive dyes are azo dyes and anthraquinone dyes and, most particularly, polyazo dyes containing 2 to 6 sulfonic acid groups.

The aftertreatment of this invention is preferably carried out by the exhaust process; but it can be equally well carried out continuously by spraying or, preferably, by the pad method.

In the exhaust process, the liquor to goods ratio may be chosen within a wide range, e.g. from 1:3 to 1:100, preferably from 1:10 to 1:50. The dyeing temperature is conveniently in the range from 20° to 98° C., preferably from 25° to 60° C. in the exhaust process and 20° to 30° C. in the pad process.

Special apparatus is not required for carrying out the process of this invention. Conventional dyeing apparatus such as open baths, winchbecks, jiggers, paddle, jet or circulation dyeing machines may be employed.

The treatment baths contain each of components (A) and (B) in the exhaust process preferably in an amount of 0.1 to 3% by weight, in particular 0.15 to 2% by weight or, most preferably, 0.15% to 0.6% by weight, based on the weight of the cellulosic material, whereas in padding liquors, components (A) and (B) are each conveniently used in an amount of 0.5 to 40 g/l, preferably 1 to 20 g/l. Components (A) and (B) are present in the weight ratio indicated above. In the pad process, the pick-up is conveniently from 60 to 120% by weight.

The dyebaths may contain mineral acids such as sulfuric acid or phosphoric acid, organic acids, preferably lower aliphatic carboxylic acids such as formic acid, acetic acid or oxalic acid, and/or salts such as ammonium acetate, ammonium sulfate or sodium acetate. The acids are added in particular to adjust the pH of the dyebaths, which is normally in the range from 4 to 8, preferably from 5 to 6.

The treatment baths can also contain further conventional assistants, e.g. electrolytes such as sodium chloride or sodium sulfate, dispersants and wetting agents, as well as antifoams and further cationic fixing agents, which last mentioned compounds may also be fibre-reactive.

The aftertreatment of the cellulosic material is conveniently carried out such that the material is treated, after dyeing but from a fresh bath, with an aqueous liquor that contains components (A) and (B) and, optionally, an acid. Preferably the dyed cellulosic material is put into a liquor that contains components (A) and (B) and acid and has a pH of 4.5 to 6 and a temperature of 25° C. and the goods are treated at this temperature for 5 to 25 minutes, preferably for 10 to 15 minutes. The temperature of the bath is then raised to 40°–60° C. and the material is treated for a further 10 to 20 minutes at this temperature.

At the conclusion of the aftertreatment, the cellulosic material may be rinsed with water and subsequently dried in conventional manner.

Compared with untreated material, the dyed cellulosic material treated by the process of this invention has not only enhanced wetfastness and crockfastness, but also has a soft, fleecy handle. In addition, the sewability of the material is not impaired. Dye yield and the lightfastness of the dyeings likewise suffer no impairment.

In the following Preparatory and Application Examples, parts and percentages are by weight unless otherwise indicated. The amounts of dye refer to commercially available, i.e. diluted products, and amounts of assistants refer to pure substance.

PREPARATORY EXAMPLES

Example I 119.6 g of dimethylaminopropylcoconut fatty acid amide are dissolved in 70 g of isopropanol and to this solution is added a solution of 19.7 g of concentrated hydrochloric acid in 94 ml of deionised water. Then 18.5 g of epichlorohydrin are added dropwise at 55° C. over 20 minutes. The reaction temperature is then raised to 75° C. and the reaction mixture is stirred for 2 hours. After this time, amine and epoxide numbers are 0.

321 g of a 45% aqueous solution of the ammonium salt of formula

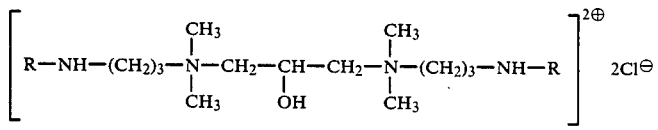

(100)

R = coconut fatty acid radical are obtained.

Example II 109.75 g of dimethylaminopropylbehenamide are dissolved in 44 g of isopropanol with heating and to this solution is then added a solution of 12.3 g of concentrated hydrochloric acid in 74 ml of deionised water. Then 11.6 g of epichlorohydrin are added dropwise at 55° C. over 15 minutes. The reaction temperature is then raised to 75° C. and the reaction mixture is stirred for 3 hours. After this time, amine and epoxide numbers are 0.

251 g of a 50% solution (wax-like at 20° C.) of the ammonium salt of formula

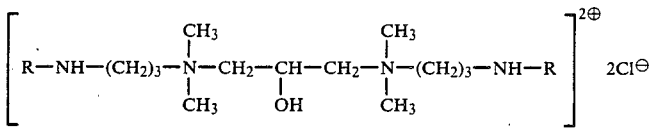

(101)

R = behenic acid radical are obtained.

Example III 84.3 g of dimethylaminopropyl-2-ethylhexanamide are dissolved in 35 g of isopropanol and to this solution is then added a solution of 18.25 g of concentrated hydrochloric acid in 73 ml of deionised water. Then 17.1 g of epichlorohydrin are added dropwise at 55° C. over 30 minutes. The reaction temperature is then raised to 75° C. and the reaction mixture is stirred for 5 hours. After this time, amine and epoxide numbers are 0.

227 g of a 50% clear solution of the ammonium salt of formula

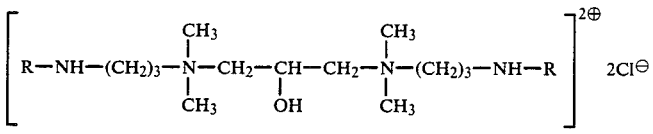

(102)

R = 2-ethylhexanoic acid radical are obtained.

Example IV

To 106.25 of dimethylaminoethylbehenamide is added at 60° C. a solution of 12.3 g of concentrated hydrochloric acid in 73 ml of water and 43 g isopropanol. Then 11.6 g of epichlorohydrin are added dropwise over 15 minutes and the reaction temperature is then raised to 75° C. The reaction solution is stirred for 10 hours at this temperature. After this time, amine and epoxide numbers are 0. The reaction solution is then evaporated to dryness, affording 122 g of the ammonium salt of formula

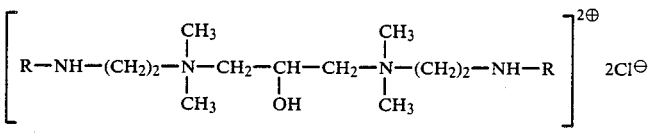

(103)

R = behenic acid radical

Preparation of dimethylaminopropylbehenamide 166 g of behenic acid are fused and heated to 160° C. under nitrogen. Then 58.85 g of dimethylaminopropylamine are added dropwise over 1½ hours while removing the water formed through a descending cooler. After 5 hours at 170°–175° C. the reaction is complete. The acid number is 0 and the amine number is 138 (theory: 133).

The dialkylaminoalkylbehenamides or dialkylaminoalkylbehenates listed in Table i are prepared in similar manner by reacting behenic acid with the appropriate diaminoalkylamine or dialkylaminoalkanol.

TABLE i

| Dialkylaminoalkylamine or dialkylaminoalkanol | Dialkylaminoalkylbehenamide or dialkylaminoalkylbehenate | Amine number |
|---|---|---|
| dimethylaminoethylamine | dimethylaminoethylbehenamide | 131.7 |
| diethylaminoethylamine | diethylaminoethylbehenamide | 134 |
| diisopropylaminoethylamine | diisopropylaminoethylbehenamide | 132 |
| dimethylaminoneopentylamine | dimethylaminoneopentylbehenamide | 122 |
| dimethylamino-n-propanol | dimethylamino-n-propylbehenate | 138.6 |

Example V

To 101 g of dimethylaminopropylbehenate is added at 60° C. a solution of 12.3 g of concentrated hydrochloric acid in 73 g of water. Then 11.6 g of epichlorohydrin are added dropwise over 15 minutes and the reaction temperature is then raised to 75° C. The reaction solution is stirred for 10 hours at this temperature. After this time, amine and epoxy numbers are 0. The reaction solution is then evaporated to dryness, affording 117 g of the ammonium salt of formula (104)

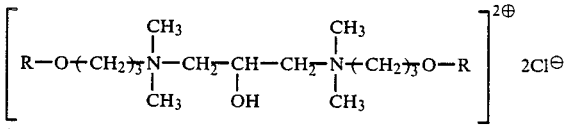

R = behenic acid radical

Example VI

To 104.5 g of diethylaminoethylbehenamide is added at 60° C. a solution of 12.3 g of concentrated hydrochloric acid in 73 g of water. Then 11.6 g of epichlorohydrin are added dropwise over 15 minutes and the reaction temperature is then raised to 75° C. The reaction solution is stirred for 10 hours at this temperature. After this time, amine and epoxy numbers are 0. The reaction solution is then evaporated to dryness, affording 120 g of the ammonium salt of formula

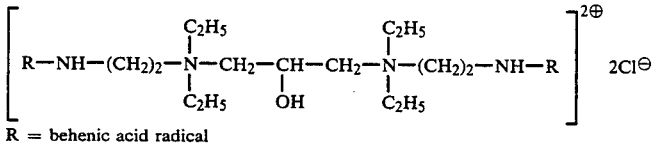

(105)

R = behenic acid radical

Example VII 24 g of dimethylaminopropylbehenamide are heated in 27 g of dimethylformamide to 100° C. Then a solution of 11.2 g of diethylene glycol-bis(4-methylbenzene)sulfonate in 25.8 g of dimethylformamide is added dropwise over 30 minutes and the reaction mixture is stirred for 10 hours at 100°-105° C. After this time the amine content is 0. The reaction solution is then evaporated to dryness under vacuum, affording 35 g of the ammonium salt of formula

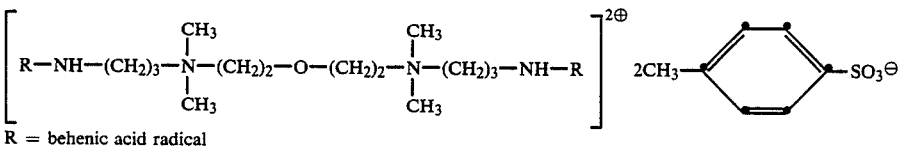

(106)

R = behenic acid radical

Example VIII 43.85 g of dimethylaminopropylbehenamide are heated in 50 g of dimethylformamide to 100° C. Then a solution of 19.9 g of 1,4-butanediol-bis(4-methylbenzene)sulfonate in 45.6 g of dimethylformamide is added dropwise over 30 minutes and the reaction mixture is stirred for 10 hours at 100°-105° C. After this time the amine content is 0. The reaction solution is then evaporated to dryness under vacuum, affording 63 g of the ammonium salt of formula

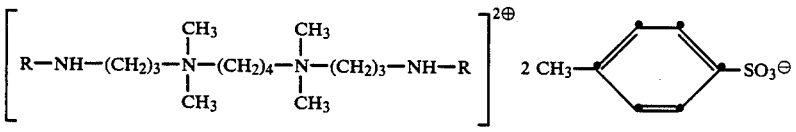

(107)

R = behenic acid radical

Example IX 43.85 g of dimethylaminopropylbehenamide are heated in 50 g of dimethylformamide to 100° C. Then a solution of 13.7 g of 1,6-hexanediol-bis(methylsulfonate) in 36.4 g of dimethylformamide is added dropwise over 45 minutes and the reaction mixture is stirred for 8 hours at 100° C. After this time the amine content is 0. The reaction solution is then evaporated to dryness, affording 57.5 g of the ammonium salt of formula

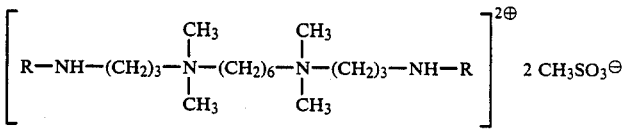

(108)

R = behenic acid radical

Example X 63.3 g of dimethylaminopropylbehenamide are fused at 80° C. Then 14.8 g of hydrochloric acid in 756.8 g of water are added dropwise to the melt while keeping the temperature at 60° C. Then 16.35 g of butanediol diglycidyl ether are added dropwise over 10 minutes and the reaction mass is stirred for 1 hour at 65°-70° C. After this time amine and epoxide numbers are 0.

850 g of a 10% solution of the diquaternary ammonium salt of the following formula

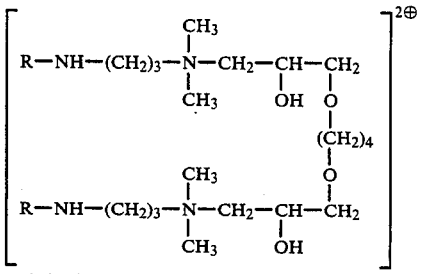

(109)

R = behenic acid radical are obtained.

Example XI 65.6 g of dimethylamino-n-propylbehenamide are fused at 80° C. and to this melt are added 5.1 g of sulfuric acid in 1083.6 g of water. To the reaction mixture are then added 16.35 g of 1,4-butanediol diglycidyl ether (epoxy number 4.6) at 60° C. over 10 minutes. The reaction mixture is heated to 70° C. and kept at this temperature for 10 hours. After this time the amine number is 28 and the epoxide number 0.

1170 g of a 7% solution of the diquaternary ammonium salt of formula

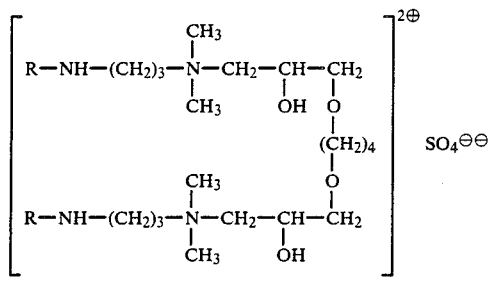

(110)

R = behenic acid radical are obtained.

Example XII 45.8 g of dimethylamino-neopentylbehenamide and 9.9 g of concentrated hydrochloric acid are heated in 500.4 g of water to 75° C. Then 10.9 g of 1,4-butanediol diglycidyl ether (epoxy number 4.6) are added over 15 minutes and the reaction mixture is stirred for 12 hours at 77°-78° C. After this time amine and epoxide numbers are 0.

567 g of a 10% solution of the diquaternary ammonium salt of formula

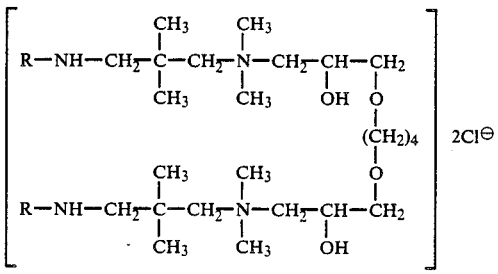

(111)

R = behenic acid radical are obtained.

Example XIII 42.3 g of diisopropylaminoethylbehenamide and 9.9 g of concentrated hydrochloric acid are heated in 479.8 g of water to 75° C. Then 10.9 g of 1,4-butanediol diglycidyl ether (epoxy number 4.6) are added over 15 minutes and the reaction mixture is stirred for 12 hours at 75° C. After this time amine and epoxide numbers are 0.

542 g of a 10% solution of the diquaternary ammonium salt of formula

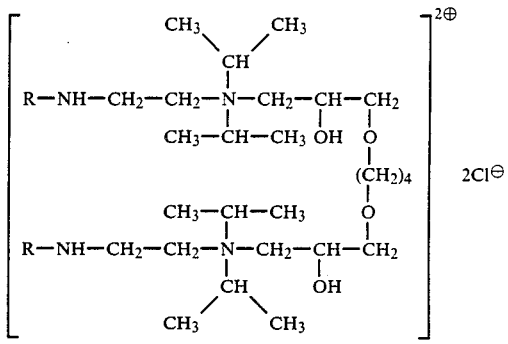

(112)

R = behenic acid radical are obtained.

APPLICATION EXAMPLES

Example 1

Cotton tricot is exhaust dyed in conventional manner at a liquor to goods ratio of 1:20 with 2% of a dye of formula

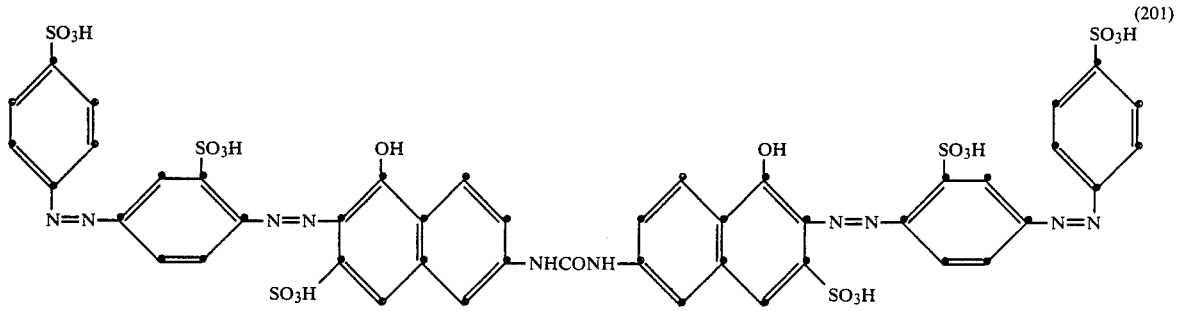

(201)

and with the addition of 20 g/l of sodium chloride. The goods are then rinsed warm and cold.

Half of the dyed goods are put into a fresh treatment bath at a liquor to goods ratio of 1:40. The aqueous liquor contains, based on the weight of the goods 0.2% of the diquaternary ammonium salt of formula (101) and 0.2% of the reaction product of 1 mole of diethylenetriamine and 1 mole of dicyandiamide according to Example 1 of DE-B-1 595 390, and has been adjusted with acetic acid to pH 5.5.

The goods are subsequently treated for 15 minutes at 25° C. and the temperature is raised to 50° C., after which the goods are treated for another 15 minutes at this temperature and then centrifuged and dried.

Example 2

The procedure of Example 1 is repeated, but effecting the aftertreatment with an aqueous liquor which contains, based on the weight of the goods
0.2% of the reaction product of
1 mole of diethylenetriamine and
1 mole of dicyandiamide, and
0.2% of the diquaternary ammonium salt of formula (107).
The pH is 5.5.

Example 3

The procedure of Example 1 is repeated, but effecting the aftertreatment with an aqueous liquor which contains, based on the weight of the goods
0.45 % of the diquaternary ammonium salt of formula (101).
0.15% of the reaction product of
1 mole of diethylenetriamine and
1 mole of dicyandiamide.
The pH is 5.5.

Example 4

The dyeing procedure of Example 1 is carried out. Then half of the dyed goods are padded to a pick-up of 100% with an aqueous liquor containing
4.5 g/l of the diquaternary ammonium salt of formula (107) and
1.5 g/l of the reaction product of
1 mole of diethylenetriamine and
1 mole of dicyandiamide.
and which has been adjusted with acetic acid to pH 5.5. After padding, the goods are dried.

Untreated material as well as the dyed material aftertreated according to Examples 1–4 are tested for
fastness to wet pressing (SN/ISO 105/XII)
fastness to severe wet treatments (SN/ISO 105/E01)
handle and
sewability.

The sewability test is carried out by the following method:
sewing machine Overlock Union Special, Type 39500, with 6000 stitches per minute
polyester long staple sewing yarn
seam length 50 cm
needle with Nm 70 point.

The number of holes on this 50 cm seam are counted. The fewer the number of holes, the better the sewability.

The results of the tests are reported in Table 1.

TABLE 1

| After-treatment | Handle | Fastness to wet pressing: change in shade | Fastness to wet pressing: bleeding | Fastness to severe wet treatments: change in shade | Fastness to severe wet treatments: bleeding | Sewability number number of holes |
|---|---|---|---|---|---|---|
| none | 0 | 3–4 | 2 | 3–4 | 2 | 18 |
| Example 1 | 2–3 | 4–5 | 5 | 4–5 | 5 | 3 |
| Example 2 | 2 | 4–5 | 5 | 4–5 | 5 | 4 |
| Example 3 | 3 | 5 | 5 | 5 | 5 | 2 |
| Example 4 | 2 | 5 | 5 | 4–5 | 5 | 1 |

Rating
Handle:
0 = no soft handle
1 = somewhat softer than 0
2 = appreciably softer than 0
3 = much softer than 0
Fastness properties: Assessment in accordance with the grey scale
1 = poor
5 = good Example 5

100 kg of bleached cotton tricot are exhaust dyed on a winchbeck in conventional manner at a liquor to goods ratio of 1:30 with 3% of a dye of formula

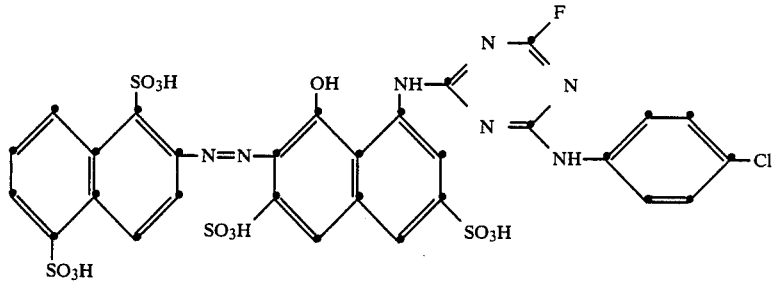

(202)

The dyeing is then rinsed cold and soaped for 20 minutes at boiling temperature with 1 g/l of the adduct of 10 moles of ethylene oxide and 1 mole of nonylphenol. The dyeing is then rinsed cold until the wash liquor is colourless.

The dyed goods are then treated in a fresh bath at 40° C. for 20 minutes with an aqueous formulation which contains, based on the weight of the goods
0.7% of the diquaternary ammonium salt of formula (109),
1.0% of the polyquaternary ammonium salt containing recurring units of the formula

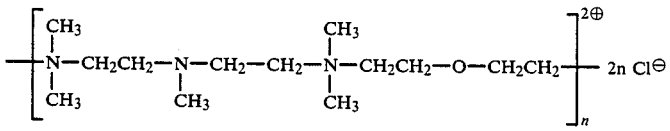

(120)

wherein
n is 3 to 8 and
0.5% of 80% acetic acid.
The pH is 5.5.

The goods are then centrifuged and dried.

For comparison purposes, a dyeing which has not been aftertreated is produced, as well as a dyeing which has only been aftertreated with the polyquaternary ammonium salt containing recurring units of formula (120).

All three dyeings are subjected to a simulated hydrolysis test by storing them for 3 days at 60° C. in a steam-saturated atmosphere.

All dyeings are tested for the following properties:

fastness to wet pressing (change in shade+bleeding on cotton)

fastness to severe wet treatments (change in shade+-bleeding on cotton), handle sewability and soiling behaviour.

The results of the above tests are reported in Table 2.

TABLE 2

| After-treatment | Handle | Fastness to wet pressing change in shade | Fastness to wet pressing bleeding | Fastness to severe wet treatments change in shade | Fastness to severe wet treatments bleeding | Sewability number of holes | Soiling |
|---|---|---|---|---|---|---|---|
| none | 0 | 4 | 2–3 | 3–4 | 2 | 19 | none |
| treatment only with compound (120) | 0 | 5 | 5 | 5 | 5 | 18 | appreciable |
| Example 5 with compounds (109) and (120) | 3 | 5 | 5 | 5 | 5 | 3 | none |

The polyquaternary ammonium salt employed in Example 5 is prepared as follows:

With stirring, 500 g of water and 168 ml of ethylene glycol are heated to 90° C. Then a mixture of 470 g of pentamethyldiethylenetriamine and 579 g of dichloroethyl ether are added, while keeping the temperature at 90°–100° C. The reaction mixture is then stirred for a further 5 hours at 110° C. and excess dichloroethyl ether is removed at 80° C. and $1.33 \cdot 10^4$ Pa. The reaction product is adjusted to 30% solids content with water, affording 2858 g of a solution of the polyquaternary ammonium salt containing recurring units of formula (120).

The pH of a 5% aqueous solution is 4.0.

Example 6

10 kg of cotton tricot are exhaust dyed in conventional manner at a liquor to goods ratio of 1:20 with 2% of a dye of formula (201) and with the addition of 20 g/l of sodium chloride. The goods are then rinsed warm and cold.

The dyed goods are then treated at a liquor to goods ratio of 1:40 with a formulation which contains, based on the weight of the goods 0.45% of the diquaternary ammonium salt of the formula (109) and 0.15% of the polyquaternary ammonium salt containing recurring units of formula (120)

and which has been adjusted with acetic acid to pH 5. Treatment is carried out initially at 25° C. for 15 minutes. Afterwards the temperature is raised to 50° C. and the goods are treated for a further 15 minutes, then rinsed and dried.

Example 7

The procedure of Example 6 is repeated, but carrying out the aftertreatment with an aqueous formulation which contains, based on the weight of the goods 0.3% of the diquaternary ammonium salt of formula (112) and 0.3% of the polyquaternary ammonium salt containing recurring units of formula (120).

The pH is 5.

Example 8

The procedure of Example 6 is repeated, but carrying out the aftertreatment with an aqueous formulation which contains, based on the weight of the goods 0.45% of the diquaternary ammonium salt of formula (110) and 0.15% of the polyquaternary ammonium salt containing recurring units of formula (120).

The pH is 5.

Example 9

The procedure of Example 6 is repeated, but carrying out the aftertreatment with an aqueous formulation which contains, based on the weight of the goods 0.15% of the diquaternary ammonium salt of formula (111) and 0.3% of the polyquaternary ammonium salt containing recurring units of formula (120).

The pH is 5.

Example 10

The procedure of Example 6 is repeated, but carrying out the aftertreatment with an aqueous formulation which contains, based on the weight of the goods 0.45% of the diquaternary ammonium salt of formula (112) and 0.15% of the reaction product of 1 mole of diethylenetriamine and 1 mole of dicyandiamide.

The pH is 5.

The dyeings aftertreated in accordance with Examples 6 to 10 are tested for the following properties:

fastness to wet pressing (SN/ISO 105/XII)

fastness to severe wet treatments (SN/ISO 105/E01)

handle and soiling.

The results of the tests are reported in Table 3.

TABLE 3

| After-treatment | Handle | Fastness to wet pressing change in shade | Fastness to wet pressing bleeding | Fastness to severe wet treatments change in shade | Fastness to severe wet treatments bleeding | Soiling |
|---|---|---|---|---|---|---|
| Example 6 | 3 | 5 | 5 | 5 | 5 | none |
| Example 7 | 2–3 | 4–5 | 5 | 5 | 5 | none |
| Example 8 | 2–3 | 5 | 5 | 5 | 5 | none |
| Example 9 | 3 | 4–5 | 4–5 | 5 | 5 | none |

TABLE 3-continued

| After-treatment | Handle | Fastness to wet pressing: change in shade | Fastness to wet pressing: bleeding | Fastness to severe wet treatments: change in shade | Fastness to severe wet treatments: bleeding | Soiling |
|---|---|---|---|---|---|---|
| Example 10 | 3 | 5 | 5 | 5 | 5 | none |

Rating
Handle:
0 = no soft handle
1 = somewhat softer than 0
2 = appreciably softer than 0
3 = much softer than 0
Fastness properties: Assessment in accordance with the grey scale
1 = poor
5 = good

What is claimed is:

1. A process for aftertreating dyed cellulosic fibre material, which comprises treating said material with an aqueous liquor comprising (A) a diquaternary ammonium salt of formula

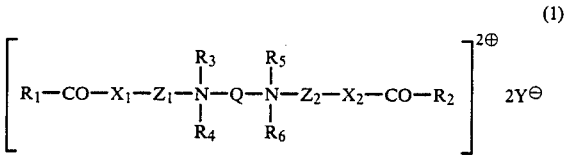

(1)

wherein

Q is a divalent aliphatic hydrocarbon radical of 2 to 12 carbon atoms which may be interrupted in the chain by oxygen atoms and is unsubstituted or substituted by hydroxy groups, $R_1$ and $R_2$ are each independently of the other an aliphatic radical of 6 to 24 carbon atoms, $R_3$ to $R_6$ are each independently of the other lower alkyl, hydroxy-lower alkyl or lower alkoxy-lower alkyl, $X_1$ and $X_2$ are each independently of the other oxygen or —NH—, $Z_1$ and $Z_2$ are each independently of the other $C_2$–$C_6$alkylene, and $Y^{\ominus}$ is an anion of a strong inorganic or organic acid, and (B) a polybasic nitrogen-containing polycondensate.

2. A process according to claim 1, wherein $R_1$ and $R_2$ are each independently of the other a $C_{19}$–$C_{21}$alkyl radical.

3. A process according to claim 1, wherein $X_1$ and $X_2$ are each —NH—.

4. A process according to claim 1, wherein $Z_1$ and $Z_2$ are each independently of the other ethylene or propylene.

5. A process according to claim 1, wherein Q is a $C_3$–$C_{10}$alkylene radical which may be interrupted in the chain by oxygen and is unsubstituted or substituted by hydroxy.

6. A process according to claim 5, wherein Q is

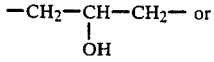

-continued

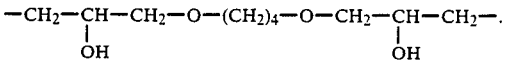

7. A process according to claim 1, wherein component (B) is an amino group containing condensate which is obtained by reacting dicyandiamide, cyanamide, guanidine or bisguanidine and a polyalkylenepolyamine containing not less than three amino groups.

8. A process according to claim 7, wherein component (B) is a reaction product of dicyandiamide and diethylenetriamine.

9. A process according to claim 1, wherein component (B) is a polyquaternary ammonium salt which is obtained by condensation of a peralkylated aliphatic di- or triamine with a dihaloalkyl ether.

10. A process according to claim 9, wherein component (B) is a polyquaternary ammonium salt which contains the recurring unit of formula

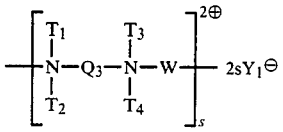

(3)

wherein $Q_3$ is $C_2$–$C_6$alkylene or a $C_2$–$C_6$alkylene radical which is interrupted by —$NT_5$—, $T_1$ to $T_5$ are each independently lower alkyl or hydroxy-lower alkyl, W is the group $-CH_2CH_2-O-CH_2CH_2-$,

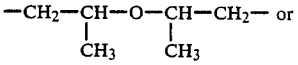

$-(CH_2)_2-O-(CH_2)_2-O-(CH_2)_2-$ s is 2 to 50, and $Y_1^{\ominus}$ is an anion of a strong inorganic or organic acid.

11. A process according to claim 1, wherein components (A) and (B) are present in a weight ratio of 4:1 to 1:4.

12. A process according to claim 11, wherein the weight ratio is 3:1 to 1:2.

13. A process according to claim 1, wherein the aftertreatment is carried out by the exhaust process.

14. A process according to claim 13, wherein components (A) and (B) are each used in an amount of 0.1 to 3% by weight, based on the weight of the cellulosic material.

15. A process according to claim 1, wherein the aftertreatment is carried out by the pad method.

16. A process according to claim 15, wherein components (A) and (B) are each used in an amount of 0.5 to 40 g/l.

17. A process according to claim 1, wherein the aftertreatment is carried out in the temperature range from 20° to 80° C.

18. A process according to claim 17, wherein the temperature range is from 25° to 60° C.

* * * * *